US007901247B2

(12) United States Patent
Ring

(10) Patent No.: US 7,901,247 B2
(45) Date of Patent: Mar. 8, 2011

(54) ELECTRICAL CONNECTORS AND SENSORS FOR USE IN HIGH TEMPERATURE, HIGH PRESSURE OIL AND GAS WELLS

(75) Inventor: Christopher S. Ring, Houston, TX (US)

(73) Assignee: Kemlon Products & Development Co., Ltd., Pearland, TX (US)

( * ) Notice: Subject to any disclaimer, the term of this patent is extended or adjusted under 35 U.S.C. 154(b) by 0 days.

(21) Appl. No.: 12/455,946

(22) Filed: Jun. 10, 2009

(65) Prior Publication Data

US 2010/0317228 A1 Dec. 16, 2010

(51) Int. Cl.
*H01R 13/58* (2006.01)

(52) U.S. Cl. ..... 439/606

(58) Field of Classification Search ..... 439/606, 439/736, 281, 693, 933, 604, 587
See application file for complete search history.

(56) References Cited

U.S. PATENT DOCUMENTS 5,030,135 A * 7/1991 Plesinger ..... 439/447
6,142,829 A * 11/2000 O'Groske et al. ..... 439/620.08
6,165,013 A * 12/2000 Broussard ..... 439/606
6,439,933 B1 * 8/2002 Moji ..... 439/669
6,506,083 B1 * 1/2003 Bickford et al. ..... 439/736
6,957,981 B2 * 10/2005 Karino et al. ..... 439/606
6,984,150 B2 * 1/2006 Kondou et al. ..... 439/606
7,168,984 B2 * 1/2007 Perle et al. ..... 439/606
7,285,015 B2 * 10/2007 Helbok et al. ..... 439/606
7,435,112 B1 * 10/2008 Miller et al. ..... 439/141
7,507,108 B2 * 3/2009 Tsuji ..... 439/446
2003/0146819 A1 * 8/2003 Shibayama ..... 338/22 R
2003/0168336 A1 * 9/2003 Downer et al. ..... 204/424
2004/0212477 A1 * 10/2004 Shibayama ..... 338/25
2006/0013282 A1 * 1/2006 Hanzawa et al. ..... 374/163

* cited by examiner

*Primary Examiner* — Jean F Duverne
(74) *Attorney, Agent, or Firm* — William E. Johnson, Jr.

(57) ABSTRACT

An electrical connector having no glass seals, while having a single electrical conductor embedded in a thermoplastic body, with a section of the electrical conductor also being enclosed within a insulating ceramic bushing, wherein the electrical conductor has an enlarged diameter portion sized to allow the enlarged portion to sealingly engage one end of the ceramic insulating bushing, wherein such engagement prevents the extrusion of the thermoplastic body along the electrical conductor through the interior of the insulating ceramic bushing. Alternative embodiments include electrical connectors having multiple pin electrical conductors and downhole sensors.

65 Claims, 9 Drawing Sheets

ELECTRICAL CONNECTORS AND SENSORS FOR USE IN HIGH TEMPERATURE, HIGH PRESSURE OIL AND GAS WELLS

BACKGROUND OF THE INVENTION

The present invention relates to electrical connectors and sensors useful in many applications, but particularly intended for use in hostile environments. More specifically, the present invention relates to single and multi-pin electrical connectors and sensors for use in high-pressure, high-temperature applications which commonly occur in the oilfield, but which are also encountered in geothermal and research applications.

Oil wells are being drilled to deeper depths and encountering harsher conditions than in the past. Many of the electrical connectors in the oilfield are exposed to the environment of the open well bore, where at maximum depth, pressures rise to over 30,000 psig, temperatures exceed 500 degrees, F, and the natural or chemically-enhanced well bore environment is extremely corrosive.

There have been many attempts made in the prior art to design, manufacture and market electrical connectors for use in such hostile environments, some of which have met with more success than others. For example, U.S. Pat. No. 6,582,251 to Burke et al, describes an "all plastic" body connector, i.e., all plastic other than for the metal conductor pin and the threaded metal body, in which the metal conductor pin is embedded in a molded body formed from polyetherketone (PEK), or other polymeric materials such as ULTEM, PAEK, PEEK or PEKK. When used with a threaded metal body, the plastic body will oftentimes extrude away from the metal conductor pin, causing the conductor pin to contact the metal body, causing immediate failure. At temperatures and pressures approaching 500° F. and 30,000 psi, respectively, the extrusion can be so severe that fluids leak between the conductor and the threaded metal body and flood the very instrument the connector was intended to protect.

The all plastic connector, even when not used with a metal body, will oftentimes fail, based upon the extrusion of the plastic in the instrument gland may cause the conductor pin to move so much that the connection to the boot is lost. In extreme cases the extrusions give rise to a hydraulic failure due to deformation of the o-ring gland of the connector to the point that the seal is no longer effective.

In addition to the all plastic connector, the prior art also includes U.S. Pat. Nos. 3,793,608 and 3,898,731, each to Sandiford Ring and Russell K. Ring, which disclose electrical connectors which operate quite well in harsh environmental such as very hot, very deep, high pressure wells, in which such connectors use glass seals in combination with ceramic seals.

In addition, U.S. Pat. No. 7,364,451 to John H. Ring and Russell K. Ring discloses an electrical connector for use in very hot, high pressure wells using, in combination, glass seals, ceramic seals, a plastic body molded, for example, from aromatic polyetherketones or other thermoplastic materials and in some embodiments, includes a thermoplastic jacket made from PAEK, PEEK, PEK and PEKK, or the like.

However, even with all the success experienced by the electrical connectors using glass seals in combination with ceramic seals, it should be appreciated that glass seals are relatively expensive. There thus exists a need for electrical conductors in high pressure, high temperature wells without the use of glass seals. The electrical connectors of the present invention provides some of the high pressure, high temperature capabilities of the hybrid type of connectors, but having manufacturing costs quite similar to the all plastic versions of electrical connectors of the prior art.

DETAILED DESCRIPTION OF PREFERRED EMBODIMENTS OF INVENTION

Figure 1:
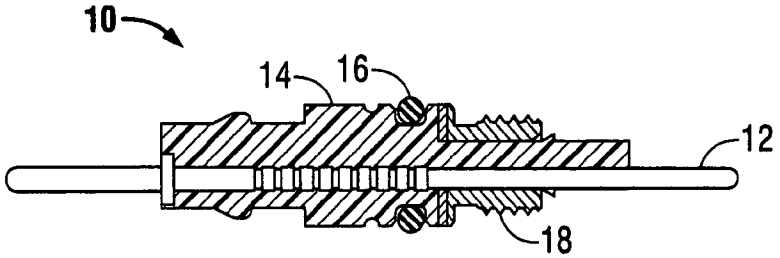
FIG. 1 (Prior Art)
FIG. 1 is an elevated view, in cross-section, illustrating an electrical connector, known in the prior art, commonly known as an all plastic connector, having a body molded from insulative thermoplastic, illustrating a first mode of failure.

Referring now to FIG. 1, a prior art, all plastic electrical connector 10 having an electrical conductor located within the interior of an all plastic body 14, with the plastic body 14 typically molded around the metal electrical conductor 12. A rubber O-ring 16 is also located on the exterior surface of the plastic body 14. A threaded metal body 18 encircles a portion of the plastic body 14. All too often, the plastic body 14 extrudes away from the electrical conductor 12, allowing the conductor 12 to touch the metal body 18, causing immediate failure of the intended function of the connector 10.

Figure 2:
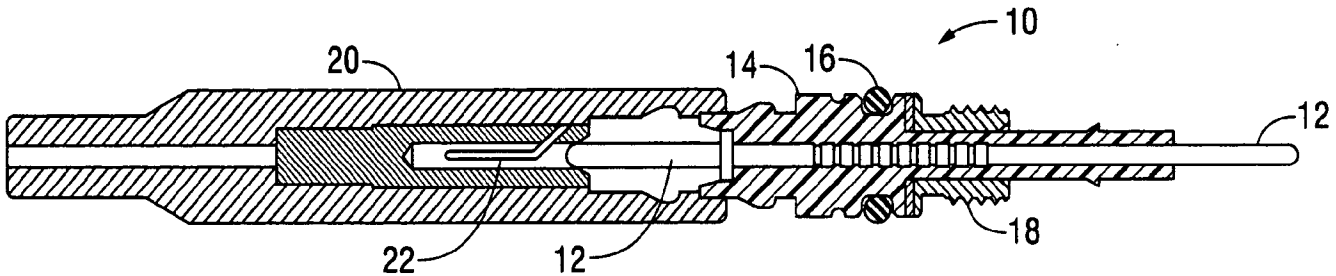
FIG. 2 (Prior Art)
FIG. 2 is an elevated view, in cross-section, illustrating the prior art electrical connector of FIG. 1, showing a second mode of failure when used with a rubber boot.

FIG. 2 illustrates a second failure mode of the all plastic, prior art connector 10 illustrated in FIG. 1. When used with a rubber boot 20, the pin 12 depends upon electrical contact with electric conductor 22 in normal operation. The boot normally excludes conductive fluids from reaching the conductor while making a reliable electrical connection. Under extremes of temperature and pressure, the plastic body deforms and extrudes through the threaded metal body 18, carrying with it the conductor pin 12 that disconnects with contact 22 and causing in this case both an electrical and hydraulic failure.

Thus, the all plastic connectors illustrated in FIGS. 1 and 2 are prone to failure in the field, for a plurality of reasons.

FIGS. 3 and 4A-4F illustrate an electrical connector 30 according to the invention having a body 34 molded around the metallic electrical connector pin 32. The electrical conductor pin 32 may be comprised of Inconel, Monel, copper, Alloy 52, beryllium copper, molybdenum, stainless steel, brass, nickel-iron bearing alloys, and other known conductive materials.

The molded plastic body 34 is preferably comprised of insulative thermoplastic, and even more preferably from aromatic polyetherketones (PEK, PEEK) but can also be comprised of other polymeric materials such as PAEK and PEKK, and blends of PEK, PEEK, PAEK and PEKK with other plastics, thermosets, modifiers, extenders and polymers.

The insulating bushing 36 is comprised of a strong insulator, preferably from ceramic, zirconia, or other known strong insulators, for example, aluminium oxide (Alumina), mullite, silicon nitride, or forsterite. Non-conductive silicon carbide can also be used as a strong insulator, but it should be appreciated that some versions of silicon carbide are conductive and should not be used as a strong insulator for this application. The insulating bushing 36 is comprised of an electrical insulator with high compressive strength, preferably ceramic, zirconia, or similar material that will not melt, weaken or significantly degrade at well bore temperatures. The present invention does not use a glass seal.

The threaded support washer/sleeve 38 can be comprised from a variety of metals, but preferably is comprised of beryllium copper, Inconel or stainless steel. The O-ring is comprised of rubber. The threads on the washer/sleeve 38 are typically provided for installation of the connector, but are considered to be optional.

Figure 3:
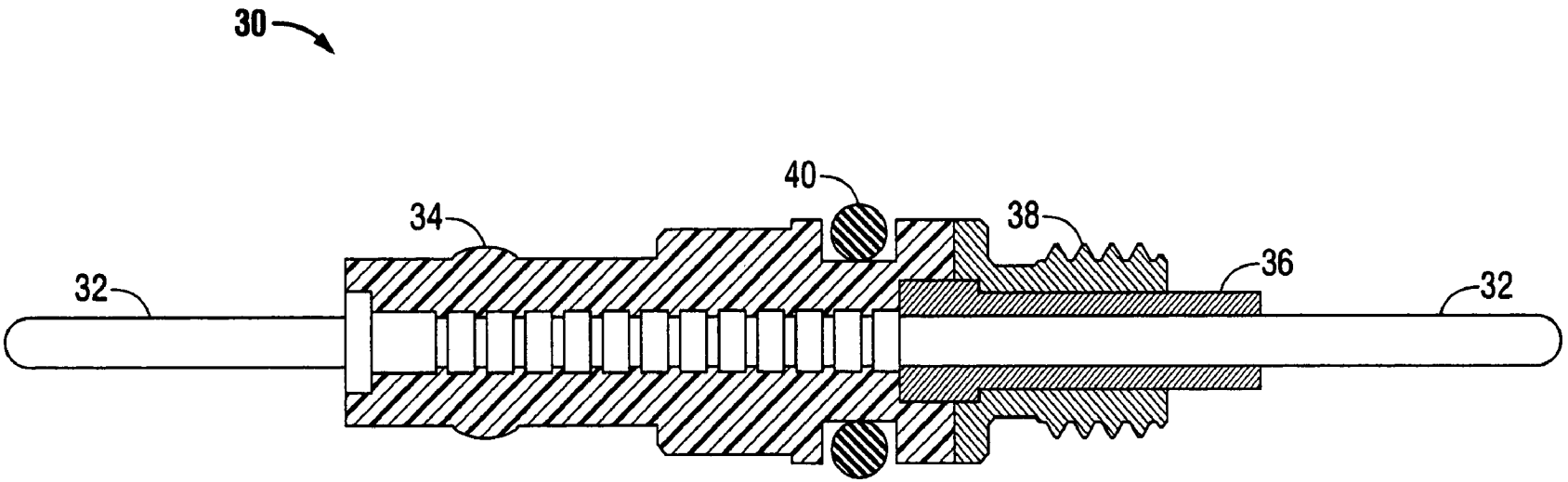
FIG. 3 is an elevated view, partly in cross-section, of an electrical connector having a single conductor pin according to the present invention.
Figure 4B:
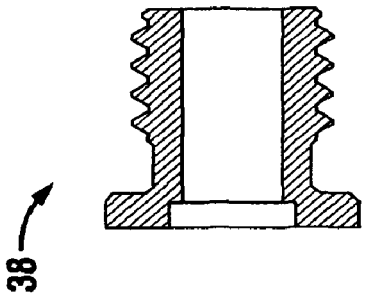
FIGS. 4A-4F, together provide an exploded view, with some parts in cross section, of the electrical connector illustrated in FIG. 3, showing a process for manufacturing and assembling such electrical connector, according to the invention.
Figure 4A:
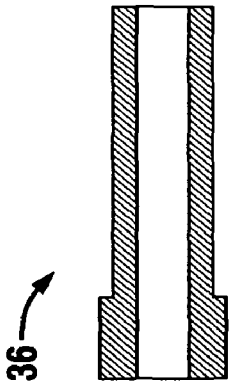
Figure 4C:
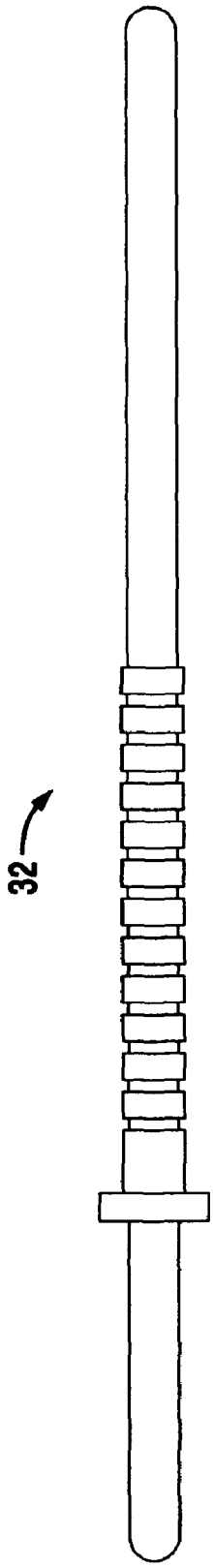

In FIGS. 4A-4F, there is illustrated a preferred process for manufacturing and assembling the electrical connector according to FIG. 3. The insulating bushing 36 of FIG. 4A, the support washer/sleeve 38 of FIG. 4B and the conductor pin 32 of FIG. 4C are preferably fabricated as single components, and then assembled, but could be fabricated, if desired, as a single component comprising the conductor pin 32, the insulating bushing 36 and the washer/sleeve 38, or as a single component combining any one of the three components with one of the remaining two components.

Figure 4D:
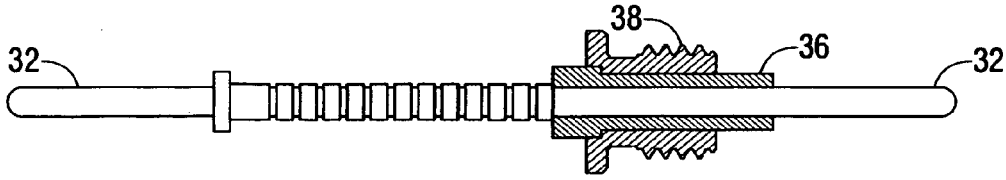

FIG. 4D illustrates, before the molding step, the assembly of components 32, 36 and 38, with the insulating bushing 36 being slidably engaged over the conductor pin 32 until preferably contacting a shoulder on the conductor pin 32. As illustrated and described hereinafter, the connectors according to the invention preferably has the shoulder on the conductor pin 32, but the connector according to the invention will also function in an acceptable manner without the shoulder, as illustrated and described with respect to FIG. 10. The washer/sleeve 38 is slidably engaged over the exterior surface of the insulating bushing 36 until a shoulder of the insulating bushing 36 preferably engages a shoulder of the washer/sleeve 38. All three components are preferably assembled together, wherein such components are fixedly connected together by well known processes involving bonding, cement, glue, epoxy or other materials, in the final assembly, having melting temperatures well in excess of 500° F. to remain secure during molding at very high temperatures and very high pressures.

Figure 4E:
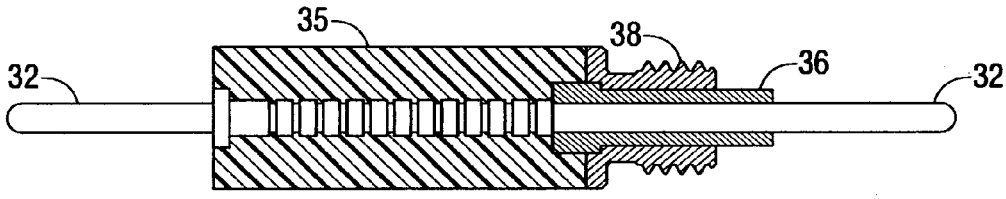
Figure 4F:
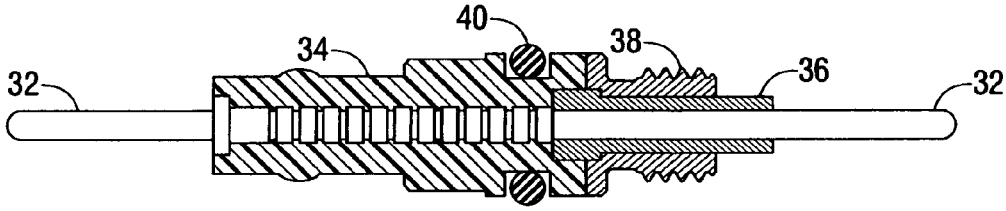

FIG. 4E illustrates the assembly illustrated in FIG. 4D, after the molding step, but prior to the machining step used to achieve the end product illustrated in FIG. 4F. With the O-ring 40 in place, also shown in FIG. 3 and in FIG. 4E, the molded body 35 becomes body 34 as a consequence of the final machining step.

Figure 4G:
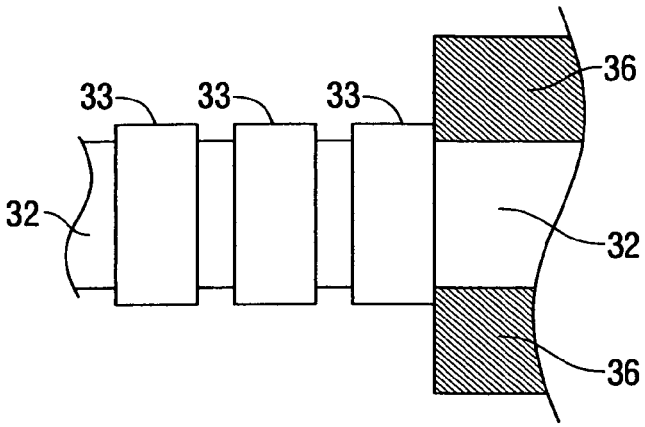
FIG. 4G graphically illustrates a partial view of the interface of a raised section on the electrical conductor pin sealing against the insulated bushing illustrated in FIG. 3.

Referring now to FIG. 4G, there is illustrated a partial, enlarged view of an important, but optional, feature of the present invention. In the one or more embodiments illustrated in FIGS. 3, 4A-4G, 5, 6, 7, 8, 9 and 10, the electrical conductor pin or pins each have a plurality of enlarged diameter areas, for example, areas 33 in FIG. 4G. The diameter of the area 33 is preferably greater than the diameter of the conductor pin 32 mounted within the interior channel of the ceramic insulating bushing 36. This difference in diameter creates a seal between the thermoplastic body 34 (FIG. 3) and the raised area 33, on the one hand, and the ceramic insulating bushing, wherein such seal prevents the thermoplastic from extruding along the conductor pin 32 and through the inside diameter of the ceramic insulating bushing 36, thus effectively eliminating the failure modes discussed herein with respect to all plastic electrical connectors. A second seal between the ceramic insulating bushing 36 and threaded sleeve 38 prevents the extrusion of thermoplastic along the outside diameter of the ceramic insulating bushing 36 at location 60 of FIG. 3, thus helping to eliminate the failure modes discussed herein with respect to all plastic electrical connectors.

Figure 5:
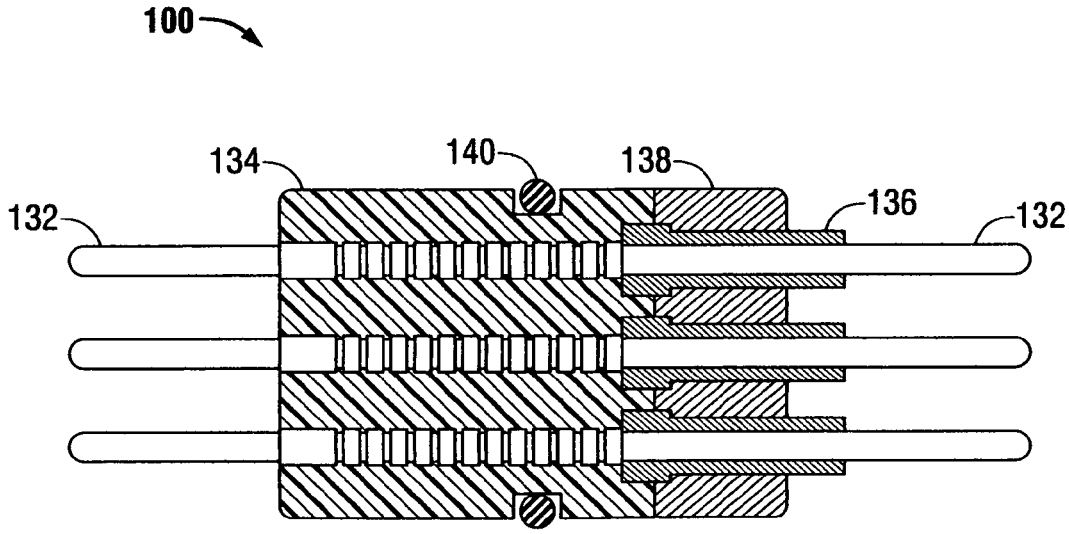
FIG. 5 an elevated view, partly in cross-section, of an electrical connector having multiple conductor pins according to the invention.

Referring now to FIG. 5, there is illustrated a multi-pin electrical connector 100, according to the invention, having a plastic body 134 molded around the plurality of electrical connector pins 132. The electrical conductor pins 132 may be comprised of Inconel, Monel, Alloy 52, beryllium copper, molybdenum, stainless steel, brass, nickel-iron bearing alloys, and other known conductive materials.

The molded plastic body 134 is preferably comprised of insulative thermoplastic, and even more preferably from aromatic polyetherketones (PEK, PEEK) but can also be comprised of other polymeric materials such as PAEK and PEKK, and blends of PEK, PEEK, PAEK and PEKK with other plastics, thermosets, modifiers, extenders and polymers.

The plurality of insulating bushings 136 are each comprised of a strong insulator, preferably from refractory materials, non-conducting silicon carbides, ceramic, zirconia or other high strength insulating materials that do not melt, weaken, or significantly degrade at well bore temperatures.

The threaded support washer/sleeve 138 can be comprised of a variety of metals, but preferably is comprised of beryllium copper, Inconel or stainless steel. The O-ring 140 is comprised of rubber. The threads on the support washer/sleeve 138 are provided for installation of the connector into the gland and are optional.

The manufacture and assembly process for the electrical conductor 100 of FIG. 5 is essentially identical to the process illustrated in FIGS. 4A-4F, and may or may not have threads on the support washer/sleeve 138.

Figure 6:
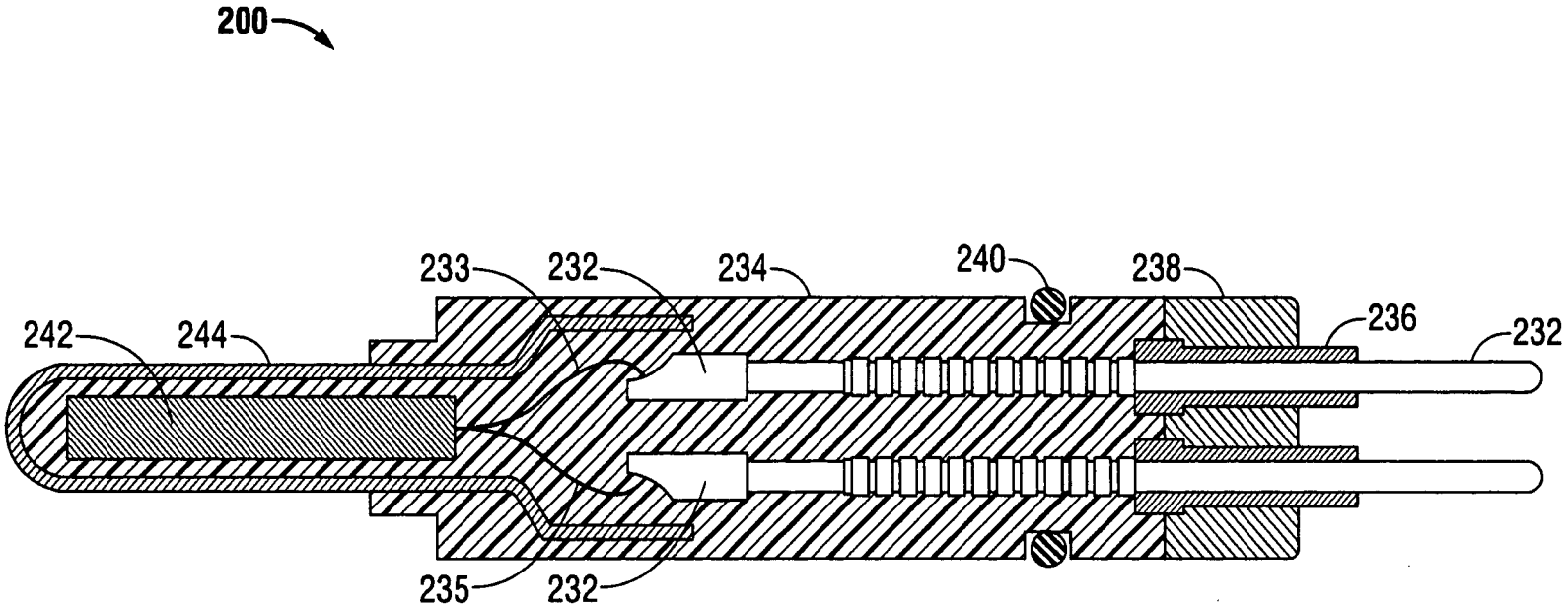
FIG. 6 is an elevated view, partly in cross section, of an electrical connector/sensor according to the invention, having multiple conductor pins used with a first type of downhole sensor.

Referring now to FIG. 6, there is illustrated a multi-pin electrical connector 200 according to the invention, having a plurality of electrical conductor pins 232 connected to a sensor element 242 embedded in the molded thermoplastic body 234. The sensor element 242 is typically protected from the downhole environment by a cover 244, as desired, and may be fabricated from metal, rubber, plastic or other known materials as needed, depending upon the type of sensor element 242 being used.

The electrical connector portion 234 of FIG. 6 is manufactured and assembled essentially identically to the process used for the electrical connector 100 of FIG. 5, other than for the use of the two connector pins 232 connected by the conductors 233 and 235, respectively, to the sensor element 242.

Figure 7:
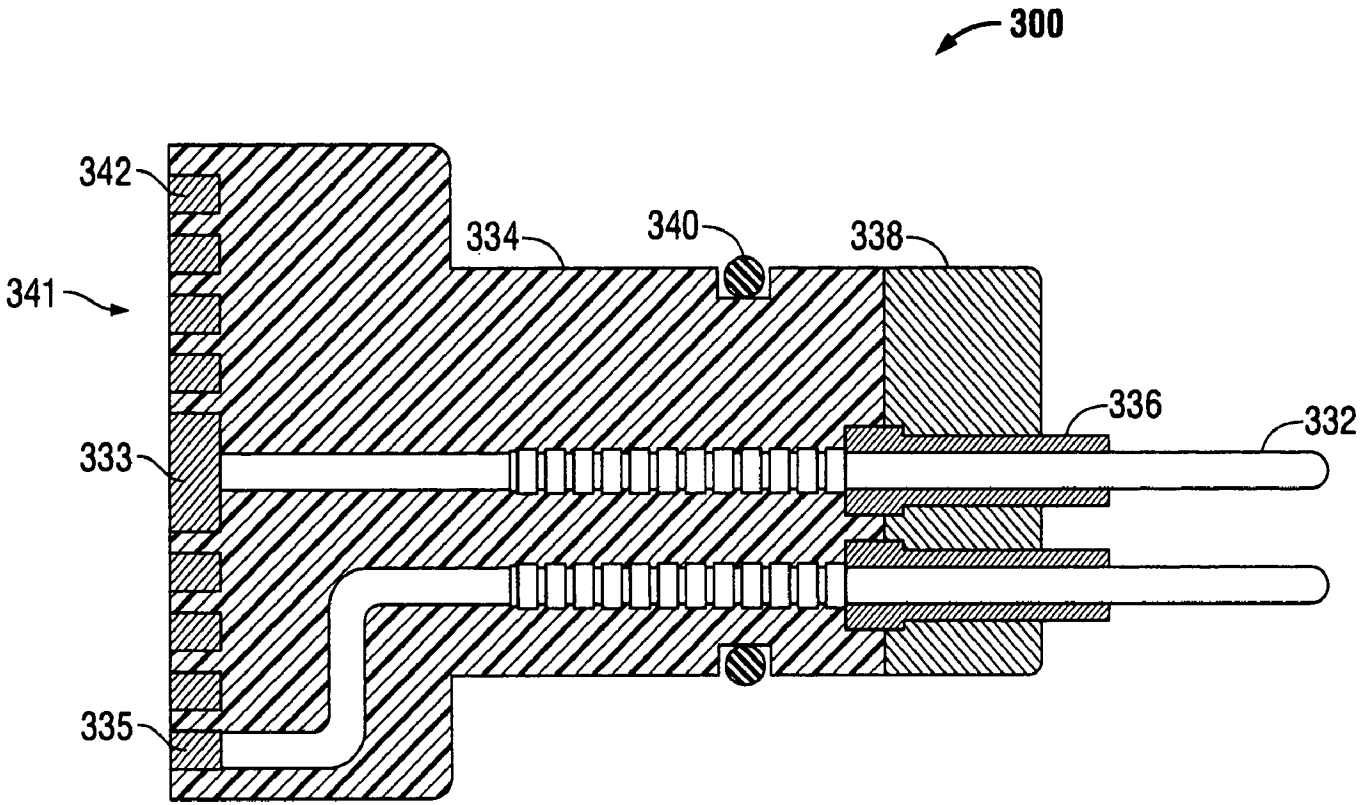
FIG. 7 is an elevated view, partly in cross section, of an electrical connector/sensor according to the invention, having multiple conductor pins used with a second type of downhole sensor.

Referring now to FIG. 7, there is illustrated a multi pin electrical connector 300, according to the invention, having a plurality of electrical conductor pins 332 connected, respectively, to a sensor element 341. The sensor element 341 comprises a plurality of electrode rings 342, two of which are rings 333 and 335 which are tied electrically to the conductor pins 332, respectively. The process for manufacturing and assembling the components included in the conductors illustrated in FIGS. 3, 4A-4F, 5, 6 and 7, 8, 9 and 10 including the materials used to manufacture the component parts of each of such electrical conductors, are essentially identical.

Figure 8:
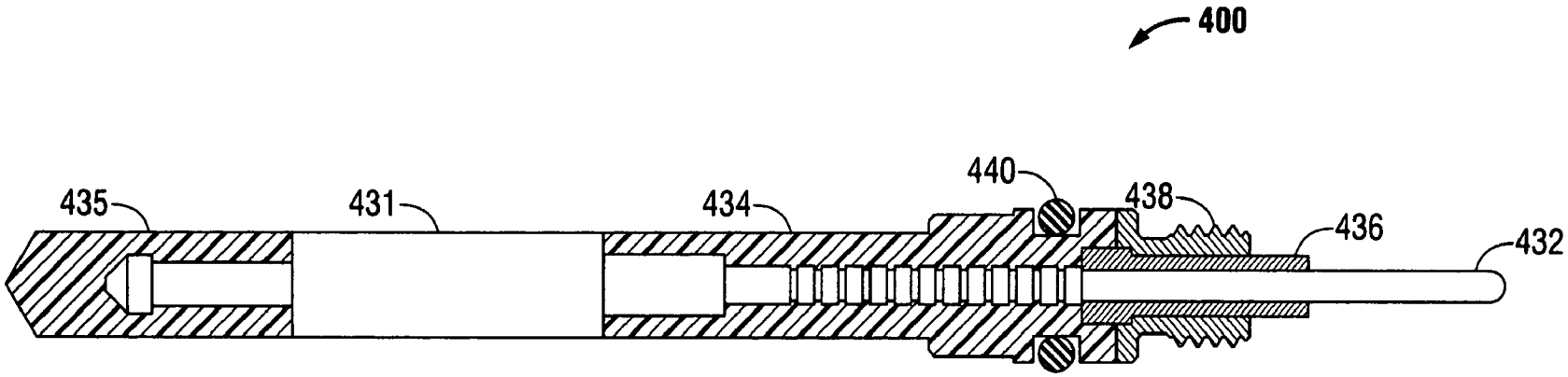
FIG. 8 is an elevated view, partly in cross section, of an electrical stab connector according to the invention.

Referring now to FIG. 8, there is illustrated a single pin electrical connector 400, according to the invention, having a single electrical conductor pin 432 connected to a metallic stabbing element 431. The stabbing element 431 may preferably comprise beryllium copper, Inconel, copper or stainless steel. The component parts 436, 438 and 440 correspond essentially with the corresponding component parts 34, 36, 38 and 40 of the connector 30 in FIG. 3, both as to the materials used, the assembly and the manufacturing process. However, the electrical conductor pin 432 is preferably fabricated as a single part to include the stabbing element 431 having a larger diameter than the diameter of the pin end 432. The body part 435 and the body part 434 are both molded from thermoplastic, and are separated from the stabbing element 431 so that electrical contact with the female receptacle (not illustrated) occurs when connector 400 is fully engaged in the intended apparatus.

It should be appreciated that the corresponding parts of the various embodiment illustrated in FIGS. 3, 4A-4F, 5, 6, 7, 8, 9 and 10 are essentially identical as to the materials used and the manufacturing and assembly process steps, other than for the first identifying digit. For example, the part 436 in FIG. 8 is essentially identical to part 36 in FIG. 3.

Figure 9:
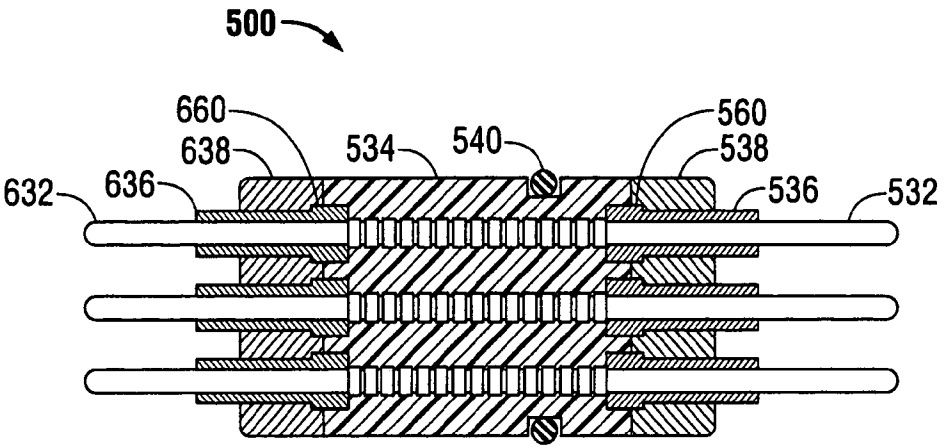
FIG. 9 is a multi-pin connector according to the invention having the ability to withstand high pressure from either or both directions.

FIG. 9 is a multi-pin connector 500 according to the invention which can withstand high pressure from either or both directions, i.e., from the conductor pin end 532 and/or from the conductor pin end 632. The corresponding component parts 532 (conductor pin), 536 (insulating bushing), 538 (threaded washer sleeve), and 560 (outside diameter at first end of insulating busing 536) are identical to parts 632, 636, 638 and 660, respectively. The thermoplastic body 534 and the O-ring 540 are common to both ends. The treaded washer sleeves 538 and 630 can be threaded, or unthreaded, as desired.

It should be appreciated that a very important feature of the present invention, is the seal formed between the thermoplastic body 34 in FIG. 3, the support washer/sleeve 38 in FIG. 3 and the insulating bushing 36 in FIG. 3. This seal is generally noted as the external surface 560 along the outside diameter of the insulating bushing 536 in FIG. 9, but is preferably present in all the embodiments of the invention illustrated in FIGS. 3, 4F, 5, 6, 7, 8, 9 and 10. Although being preferable, such seal is optional in all such embodiments.

Figure 10:
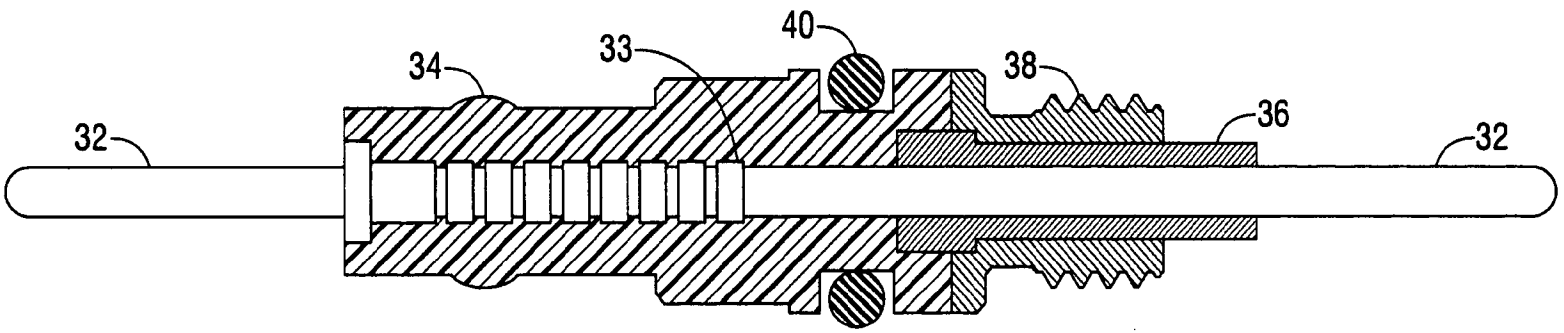
FIG. 10 is an alternative embodiment of the invention illustrated in FIG. 3.

FIG. 10 is an alternative embodiment according to the invention as illustrated in FIG. 3, but which can be used to modify FIGS. 3, 4A-4F, 4G, 5, 6, 7, 8 and 9 if desirable. FIG. 3, for example, has a raised section on its conductor pin 32 having an outside diameter greater than the internal diameter of the insulating bushing 36 creating a seal as herein discussed. In FIG. 10, the conductor pin 32 may or may not have the raised section, but if present, the raised section of conductor pin 32 does not seal against the insulating bushing 36. The embodiment of FIG. 3 is preferred over the embodiment of FIG. 10, but the embodiment of FIG. 10 will still provide a viable connector.

Thus, there has been illustrated and described herein the preferred embodiments of high temperature, high pressure electrical conductors having the ability to withstand pressures in excess of 30,000 psiq, and temperature in excess of 500° F., all without the use of glass seals in such conductors.

The invention claimed is:

1. An electrical connector for use in high temperature, high pressure oil and gas wells, comprising:

An insulative thermoplastic body having a given compressive strength;

A metallic electrical conductor pin partially embedded within the interior of said thermoplastic body, said electrical conductor having at least one section having a given external diameter; and An insulating bushing having a given compressive strength higher than the compressive strength of said thermoplastic body, and having first and second ends and also having an interior channel between said first and second ends, said electrical conductor at least partially residing within said channel, said channel having an internal diameter less than the external diameter of said at least one section of said electrical conductor.

2. The electrical connector according to claim 1, wherein the first end of said insulating bushing is sealingly engaged with said at least one section of said electrical conductor pin.

3. The electrical connector according to claim 1, wherein said insulating bushing comprises ceramic.

4. The electrical connector according to claim 1, wherein said insulating bushing comprises zirconia.

5. The electrical connector according to claim 1, wherein said insulating bushing comprises other materials with high compressive strength that do not melt, weaken, or degrade at well bore temperatures.

6. The electrical connector according to claim 1, being further characterized as having no glass seals.

7. The electrical connector according to claim 1, comprising in addition thereto, a metallic support washer/sleeve mounted on the exterior surface of said insulating bushing.

8. The electrical connector according to claim 7, wherein said support washer/sleeve has threads on its exterior surface.

9. The electrical connector pin according to claim 1, wherein the metallic electrical conductor pin consists essentially of one of the group of Inconel, Monel, Alloy 52, copper, beryllium copper, molybdenum, stainless steel, brass, nickel iron bearing alloys, and combinations thereof.

10. The electrical connector according to claim 1, wherein the insulative thermoplastic body comprises aromatic polyetherketones.

11. The electrical conductor according to claim 10, wherein the thermoplastic body comprises PEK.

12. The electrical conductor according to claim 10 wherein the thermoplastic body comprises PEEK.

13. The electrical conductor according to claim 10, wherein the thermoplastic body comprises PAEK.

14. The electrical conductor according to claim 10, wherein the thermoplastic body comprises PEKK.

15. The electrical connector according to claim 10, wherein the thermoplastic body comprises blends of one or more of PEK, PEEK, PAEK and PEKK with one or more of other plastics, thermosets, modifiers, extenders, and polymers.

16. An electrical connector for use in high temperature, high pressure oil and gas wells, comprising:

An insulative thermoplastic body having a given compressive strength ;

A metallic electrical conductor pin partially embedded within the interior of said thermoplastic body, said electrical conductor having at least one section having a given external diameter; and An insulating bushing having a given compressive strength higher than the compressive strength of said thermoplastic body, and having first and second ends and having an interior channel between said first and second ends, said electrical conductor at least partially residing within said channel, said electrical connector being characterized by having no glass seals.

17. The electrical connector according to claim 16, wherein the first end of said insulating bushing is sealingly engaged with said at least one section of said electrical conductor pin.

18. The electrical connector according to claim 16, wherein said insulating bushing comprises ceramic.

19. The electrical connector according to claim 16, wherein said insulating bushing comprises zirconia.

20. The electrical connector according to claim 16, wherein said insulating bushing comprises an insulating material with high compressive strength that will not melt, weaken or significantly degrade at well bore temperatures.

21. The electrical connector according to claim 16, comprising in addition thereto, a metallic support washer/sleeve mounted on the exterior surface of said insulating bushing.

22. The electrical connector according to claim 16, wherein said support washer/sleeve has threads on its exterior surface.

23. The electrical connector pin according to claim 16, wherein the metallic electrical conductor pin consists essentially of one of the group of Inconel, Monel, Alloy 52, copper, beryllium copper, molybdenum, stainless steel, brass, nickel iron bearing alloys, and combinations thereof.

24. The electrical connector according to claim 16, wherein the insulative thermoplastic body comprises aromatic polyetherketones.

25. The electrical connector according to claim 24, wherein the thermoplastic body comprises PEK.

26. The electrical connector according to claim 24, wherein the thermoplastic body comprises PEEK.

27. The electrical connector according to claim 24, wherein the thermoplastic body comprises PAEK.

28. The electrical connector according to claim 24, wherein the thermoplastic body comprises PEKK.

29. The electrical connector according to claim 24, wherein the thermoplastic body comprises blends of at least one of PEK, PEEK, PAEK and PEKK with at least one of other plastics, thermostats, modifiers, extenders, and polymers.

30. An electrical connector for use in high temperature, high pressure oil and gas wells, comprising:

An insulative thermoplastic body having a given compressive strength;

A plurality of metallic electrical conductor pins partially embedded within the interior of said thermoplastic body, said electrical conductor pins each having at least one section having a given external diameter; and A plurality of insulator bushings having a given compressive strength higher than the compressive strength of said thermoplastic body, and each having first and second ends and each having an interior channel between said first and second ends, each of said electrical conductor pins at least partially residing within one of said channels, said channels each having an internal diameter less than the external diameter of each of said at least one section of said electrical conductors.

31. The electrical connector according to claim 30, wherein the first end of each of said insulating bushings is sealingly engaged with said at least one section of each of said electrical conductor pins, respectively.

32. The electrical connector according to claim 30, wherein at least one said insulating bushings comprises ceramic.

33. The electrical connector according to claim 30, wherein at least one of said insulating bushings comprise zirconia.

34. The electrical connector according to claim 30, wherein each said insulating bushing comprises an insulating material with high compressive strength that will not melt, weaken or significantly degrade at well bore temperatures.

35. The electrical connector according to claim 30, being further characterized as having no glass seals.

36. The electrical connector according to claim 30, comprising in addition thereto, a metallic support washer/sleeve mounted on the exterior surface of each of said insulating bushings.

37. The electrical connector according to claim 36, wherein at least one of said support washer/sleeves has threads on its exterior surface.

38. The electrical connector according to claim 30, wherein each of said metallic electrical conductor pins consists essentially of one of the group of Inconel, Monel, Alloy 52, copper, beryllium copper, molybdenum, stainless steel, brass, nickel iron bearing alloys, and combinations thereof.

39. The electrical connector according to claim 30, wherein said insulative thermoplastic body comprises aromatic polyetherketones.

40. The electrical connector according to claim 39, wherein the thermoplastic body comprises PEK.

41. The electrical connector according to claim 39, wherein the thermoplastic body comprises PEEK.

42. The electrical connector according to claim 39, wherein the thermoplastic body comprises PAEK.

43. The electrical conductor according to claim 39, wherein the thermoplastic body comprises PEKK.

44. The electrical connector according to claim 39, wherein the thermoplastic body comprises blends of at least one of PEK, PEEK, PAEK and PEKK with at least one of other plastics, thermoset, modifiers, extenders, and polymers.

45. An electrical connector for use in high temperature, high pressure oil and gas wells, comprising:

An insulative thermoplastic body having a given compressive strength;

A plurality of metallic electrical conductor pins, each having at least one enlarged diameter section, partially embedded within the interior of said thermoplastic body, and A plurality of insulating bushings having a given compressive strength higher than the compressive strength of said thermoplastic body, and each having first and second ends and each having its own interior channel between said first and second ends, each said electrical conductor at least partially residing within one of said channels, respectively, said electrical connector being characterized as having no glass seals.

46. The electrical connector according to claim 45, wherein the first end of each of said insulating bushings is sealingly engaged with an enlarged diameter on one of said electrical conductor pins.

47. The electrical connector according to claim 45, wherein each said insulating bushing comprises ceramic.

48. The electrical connector according to claim 45, wherein each said insulating bushing comprises zirconia.

49. The electrical connector according to claim 45, wherein each said insulating bushing comprises an insulating material with high compressive strength that will not melt, weaken or significantly degrade at well bore temperatures.

50. The electrical connector according to claim 45, comprising in addition thereto, a metallic support washer/sleeve mounted on the exterior surface of each said insulating bushing.

51. The electrical connector according to claim 50, wherein each said support washer/sleeve has threads on its exterior surface.

52. The electrical connector according to claim 45, wherein each of the metallic electrical conductor pins consists essentially of one of the group of Inconel, Monel, Alloy 52, copper, beryllium copper, molybdenum, stainless steel, brass, nickel iron bearing alloys, and combinations thereof.

53. The electrical connector according to claim 45, wherein the insulative thermoplastic body comprises aromatic polyetherketones.

54. The electrical connector according to claim 53, wherein the thermoplastic body comprises PEK.

55. The electrical connector according to claim 53, wherein the thermoplastic body comprises PEEK.

56. The electrical connector according to claim 53, wherein the thermoplastic body comprises PAEK.

57. The electrical conductor according to claim 53, wherein the thermoplastic body comprises PEKK.

58. The electrical connector according to claim 53, wherein the thermoplastic body comprises blends of at least one of PEK, PEEK, PAEK and PEKK with at least one of other plastics, thermosets, modifiers, extenders, and polymers.

59. An electrical connector for use in high temperature, high pressure oil and gas wells, comprising:

An insulative thermoplastic body having a given compressive strength;

A metallic electrical conductor pin partially embedded within the interior of said thermoplastic body, said electrical conductor having at least one section having a given external diameter;

At least one sensor connected to said conductor pin; and

An insulating bushing having a given compressive strength higher than the compressive strength of said thermoplastic body, and having first and second ends and also having an interior channel between said first and second ends, said electrical conductor at least partially residing within said channel, said channel having an internal diameter less than the external diameter of said at least one section of said electrical conductor.

60. An electrical connector for use in high temperature, high pressure oil and gas wells, comprising:

An insulative thermoplastic body having a given compressive strength;

A metallic electrical conductor pin partially embedded within the interior of said thermoplastic body, said electrical conductor having at least one section having a given external diameter;

At least one sensor connected to said conductor pin; and

An insulating bushing having a given compressive strength higher than the compressive strength of said thermoplastic body, and having first and second ends and also having an interior channel between said first and second ends, said electrical conductor at least partially residing within said channel, said electrical connector being characterized by having no glass seals.

61. An electrical connector for use in high temperature, high pressure oil and gas wells, comprising:

An insulative thermoplastic body having a given compressive strength;

A plurality of metallic electrical conductor pins partially embedded within the interior of said thermoplastic body, said electrical conductor pins each having at least one section having a given external diameter;

At least one sensor connected to at least one of said conductor pins; and

A plurality of insulator bushings having a given compressive strength higher than the compressive strength of said thermoplastic body, and each having first and second ends and also each having an interior channel between said first and second ends, each of said electrical conductor pins at least partially residing within one of said channels, said channels each having an internal diameter less than the external diameter of at least one of said sections of said electrical conductor pins.

62. An electrical connector for use in high temperature, high pressure oil and gas wells, comprising:

An insulative thermoplastic body having a given compressive strength;

A plurality of metallic electrical conductor pins partially embedded within the interior of said thermoplastic body, At least one sensor connected to at least one of said conductor pins; and A plurality of insulating bushings having a given compressive strength higher than the compressive strength of said thermoplastic body, and each having first and second ends and each having its own interior channel between said first and second ends, each said electrical conductor at least partially residing within one of said channels, respectively, said electrical connector being characterized as having no glass seals.

63. An electrical connector for use in high temperature, high pressure oil and gas wells, comprising:

An insulative thermosplastic body having a given compressive strength;

A metallic electrical conductor pin partially embedded within the interior of said thermoplastic body, said electrical conductor pin having two sections each having an enlarged external diameter and said conductor pin having two ends extending from opposite sides of said thermoplastic body; and Two insulating bushings having a given compressive strength higher than the compressive strength of said thermoplastic body, and each having first and second ends and each having an interior channel between said first and second ends, respectively, said electrical conductor pin partially residing within each of said channels, respectively, said electrical connector being characterized by having no glass seals.

64. An electrical connector for use in high temperature, high pressure oil and gas wells, comprising:

An insulative thermoplastic body having a given compressive strength;

A plurality of metallic electrical conductor pins partially embedded within the interior of said thermoplastic body, said electrical conductor pins each having two sections having an enlarged external diameter; and Two insulating bushings having a given compressive strength higher than the compressive strength of said thermoplastic body, and for each of said conductor pins, each such bushing having first and second ends and each having an interior channel between said first and second ends, each of said electrical conductor pins at least partially residing within two of said channels, respectively, said channels each having an internal diameter less than the enlarged external diameter of said two sections of said electrical conductors.

65. The electrical connector according to claim 64, wherein the first end of each of said insulating bushings is sealingly engaged with one end of an enlarged diameter section of one of said electrical conductor pins.

* * * * *